US010145652B2

(12) United States Patent
Paterson et al.

(10) Patent No.: US 10,145,652 B2
(45) **Date of Patent: *Dec. 4, 2018**

(54) OPTICAL DEVICE HAVING PROJECTED AIMING POINT

(71) Applicant: Burris Company, Inc., Greeley, CO (US)

(72) Inventors: Douglas F. Paterson, Windsor, CO (US); Steven A. Bennetts, Greeley, CO (US)

(73) Assignee: BURRIS COMPANY, INC., Greeley, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/810,097

(22) Filed: Jul. 27, 2015

(65) Prior Publication Data

US 2016/0025455 A1 Jan. 28, 2016

Related U.S. Application Data

(63) Continuation of application No. 13/758,129, filed on Feb. 4, 2013, now Pat. No. 9,091,507.

(60) Provisional application No. 61/595,039, filed on Feb. 4, 2012.

(51) Int. Cl.
*F41G 1/38* (2006.01)
*F41G 3/06* (2006.01)

(52) U.S. Cl.
CPC ..... *F41G 1/38* (2013.01); *F41G 3/06* (2013.01)

(58) Field of Classification Search
CPC . F41G 1/38; F41G 1/387; F41G 1/393; F41G 1/3935
USPC ..... 42/119, 122, 123, 130, 131; 89/41.17; 235/404, 407, 411, 413, 414, 417; 359/400, 428
See application file for complete search history.

(56) References Cited

U.S. PATENT DOCUMENTS

| | | | |
|---|---|---|---|
| 691,248 | A | 1/1902 | De Zeng, Jr. |
| 722,910 | A | 3/1903 | Saegmuller |
| 773,813 | A | 11/1904 | Saegmuller |
| 830,729 | A | 9/1906 | Mann |
| 870,273 | A | 11/1907 | Burton |
| 960,813 | A | 6/1910 | Burton |
| 1,609,405 | A | 12/1926 | Fagerholm |
| 2,381,101 | A | 8/1945 | Bausch |
| 2,424,011 | A | 7/1947 | Gramo |
| 2,548,031 | A | 4/1951 | Leupold |

(Continued)

FOREIGN PATENT DOCUMENTS

| | | | |
|---|---|---|---|
| CN | 201145779 | Y | 11/2008 |
| CN | 201378019 | | 1/2010 |

(Continued)

OTHER PUBLICATIONS

Chinese 1st Office Action in Application 201310044090.X, dated Aug. 5, 2015, 17 pgs.

*Primary Examiner* — Bret Hayes

(57) ABSTRACT

An aiming device includes a set of lenses disposed along an optical path, the set of lenses including an objective lens and an ocular lens. A reflective element is disposed on the optical path between the objective lens and the ocular lens. An addressable display is located off the optical path and projects an image to the reflective element. The image is viewable through the ocular lens and is an aiming element superimposed on a field of view.

16 Claims, 10 Drawing Sheets

(56) References Cited

U.S. PATENT DOCUMENTS

| | | | |
|---|---|---|---|
| 2,579,067 | A | 12/1951 | Cunningham |
| 2,782,509 | A | 2/1957 | Ivy |
| 2,839,834 | A | 6/1958 | Hardy |
| 2,911,723 | A | 11/1959 | Ashbrook |
| 3,153,856 | A | 10/1964 | Felix |
| 3,183,594 | A | 5/1965 | Panunzi |
| 3,315,362 | A | 4/1967 | Palmer |
| 3,374,544 | A | 3/1968 | Pitchford |
| 3,401,460 | A | 9/1968 | Tellie |
| 3,611,606 | A | 10/1971 | Sefried et al. |
| 3,669,523 | A | 6/1972 | Edwards |
| 3,734,437 | A | 5/1973 | Underwood |
| 3,828,443 | A | 8/1974 | James |
| D234,539 | S | 3/1975 | Marchetti |
| D234,540 | S | 3/1975 | Marchetti |
| 3,877,166 | A | 4/1975 | Ward |
| 3,959,888 | A | 6/1976 | Baker |
| 3,994,597 | A | 11/1976 | Calder et al. |
| 4,208,801 | A | 6/1980 | Blair |
| 4,264,123 | A | 4/1981 | Mabie |
| 4,523,818 | A | 6/1985 | Lang et al. |
| 4,531,052 | A | 7/1985 | Moore |
| 4,571,870 | A | 2/1986 | Heideman et al. |
| 4,630,903 | A | 12/1986 | Jones |
| 4,643,542 | A | 2/1987 | Gibson |
| 4,695,161 | A | 9/1987 | Reed |
| 4,776,126 | A | 10/1988 | Williams |
| 4,777,754 | A | 10/1988 | Reynolds, Jr. |
| 4,845,871 | A | 7/1989 | Swan |
| 5,305,978 | A | 4/1994 | Current |
| 5,343,744 | A | 9/1994 | Ammann |
| 5,363,559 | A | 11/1994 | McCarty |
| 5,400,540 | A | 3/1995 | Solinsky et al. |
| 5,408,359 | A | 4/1995 | Ferrett et al. |
| 5,426,880 | A | 6/1995 | Ruger et al. |
| 5,430,967 | A | 7/1995 | Woodman, III et al. |
| 5,433,010 | A | 7/1995 | Bell |
| 5,506,727 | A | 4/1996 | Douglas et al. |
| 5,531,031 | A | 7/1996 | Green |
| 5,584,137 | A | 12/1996 | Teetzel |
| 5,771,623 | A | 6/1998 | Pernstich et al. |
| 5,783,745 | A | 7/1998 | Bergman |
| 5,784,207 | A | 7/1998 | Satoh |
| 5,920,995 | A | 7/1999 | Sammut |
| 5,941,489 | A | 8/1999 | Fanelli et al. |
| 5,973,315 | A | 10/1999 | Saldana et al. |
| 6,012,229 | A | 1/2000 | Shiao |
| 6,032,374 | A | 3/2000 | Sammut |
| 6,185,854 | B1 | 2/2001 | Solinsky et al. |
| 6,269,581 | B1 | 8/2001 | Groh |
| 6,363,223 | B1 | 3/2002 | Gordon |
| 6,442,883 | B1 | 9/2002 | Waterman et al. |
| 6,453,595 | B1 | 9/2002 | Sammut |
| 6,516,551 | B2 | 2/2003 | Gaber |
| 6,516,699 | B2 | 2/2003 | Sammut et al. |
| 6,574,901 | B1 | 6/2003 | Solinsky et al. |
| 6,580,555 | B2 | 6/2003 | Crista |
| 6,580,876 | B1 | 6/2003 | Gordon |
| 6,595,473 | B2 | 7/2003 | Aoki |
| 6,606,813 | B1 | 8/2003 | Squire et al. |
| 6,608,298 | B2 | 8/2003 | Gaber |
| 6,615,531 | B1 | 9/2003 | Holmberg |
| 6,629,381 | B1 | 10/2003 | Keng |
| 6,681,512 | B2 | 1/2004 | Sammut |
| 6,721,095 | B2 | 4/2004 | Huber |
| 6,729,062 | B2 | 5/2004 | Thomas et al. |
| 6,792,206 | B2 | 9/2004 | Gordon |
| 6,807,742 | B2 | 10/2004 | Schick et al. |
| 6,813,025 | B2 | 11/2004 | Edwards |
| 6,819,495 | B2 | 11/2004 | Shani et al. |
| 6,862,832 | B2 | 3/2005 | Barrett |
| 6,875,918 | B2 | 4/2005 | Sudo |
| 7,119,275 | B2 | 10/2006 | Suzuki |
| 7,121,037 | B2 | 10/2006 | Penney |
| 7,125,126 | B2 | 10/2006 | Yamamoto |
| 7,129,857 | B1 | 10/2006 | Spirkovska |
| 7,292,262 | B2 | 11/2007 | Towery et al. |
| 7,309,054 | B2 | 12/2007 | Slatter et al. |
| 7,317,520 | B2 | 1/2008 | Wang et al. |
| 7,343,707 | B2 | 3/2008 | Smith, III |
| 7,656,579 | B1 | 2/2010 | Millett |
| 7,665,699 | B2 | 2/2010 | Oddsen, Jr. et al. |
| 7,703,679 | B1 | 4/2010 | Bennetts et al. |
| 7,905,046 | B2 | 3/2011 | Smith, III |
| 8,006,430 | B2 | 8/2011 | Wang |
| D651,682 | S | 1/2012 | Beckett et al. |
| 8,201,741 | B2 | 6/2012 | Bennetts et al. |
| 8,353,454 | B2 | 1/2013 | Sammut et al. |
| 8,397,421 | B2 | 3/2013 | Ding et al. |
| 8,555,542 | B2 | 10/2013 | Ziegler |
| 8,833,655 | B2 | 9/2014 | McCarty et al. |
| 8,919,650 | B2 | 12/2014 | Browe et al. |
| 9,038,901 | B2 | 5/2015 | Paterson et al. |
| 9,091,507 | B2 | 7/2015 | Paterson et al. |
| 9,423,215 | B2 | 8/2016 | White et al. |
| 9,689,643 | B2 | 6/2017 | Farca et al. |
| 2002/0089752 | A1 | 7/2002 | Morgan, III |
| 2003/0010190 | A1 | 1/2003 | Sammut et al. |
| 2003/0145505 | A1 | 8/2003 | Kenton |
| 2003/0163278 | A1 | 8/2003 | Clark et al. |
| 2004/0047586 | A1 | 3/2004 | Schick et al. |
| 2004/0068913 | A1 | 4/2004 | Solinsky et al. |
| 2004/0082888 | A1 | 4/2004 | Palazzolo et al. |
| 2004/0088898 | A1 | 5/2004 | Barrett |
| 2004/0144013 | A1 | 7/2004 | Leatherwood |
| 2004/0187374 | A2 | 9/2004 | Solinsky et al. |
| 2004/0231220 | A1 | 11/2004 | McCormick |
| 2004/0234812 | A1 | 11/2004 | Naito et al. |
| 2004/0238714 | A1 | 12/2004 | Slatter et al. |
| 2005/0002668 | A1 | 1/2005 | Gordon |
| 2005/0021282 | A1 | 1/2005 | Sammut et al. |
| 2005/0036109 | A1 | 2/2005 | Blum et al. |
| 2005/0200959 | A1 | 9/2005 | Yamamoto |
| 2005/0219690 | A1 | 10/2005 | Lin et al. |
| 2005/0252062 | A1 | 11/2005 | Scrogin et al. |
| 2005/0263688 | A1 | 12/2005 | Kauhanen |
| 2005/0268521 | A1 | 12/2005 | Cox et al. |
| 2006/0010759 | A1 | 1/2006 | Penney |
| 2006/0010760 | A1 | 1/2006 | Perkins et al. |
| 2006/0162226 | A1 | 7/2006 | Tai |
| 2006/0164704 | A1 | 7/2006 | Sieczka et al. |
| 2006/0187562 | A1 | 8/2006 | Mounnarat et al. |
| 2007/0035824 | A1 | 2/2007 | Scholz |
| 2007/0086893 | A1 | 4/2007 | Pedersen |
| 2007/0096000 | A1 | 5/2007 | Westberg |
| 2007/0097351 | A1 | 5/2007 | York et al. |
| 2007/0234626 | A1 | 10/2007 | Murdock et al. |
| 2007/0277421 | A1 | 12/2007 | Perkins et al. |
| 2008/0007843 | A1 | 1/2008 | Schafer |
| 2008/0022576 | A1 | 1/2008 | Epling |
| 2008/0140331 | A1 | 6/2008 | Kalinin |
| 2008/0186568 | A1 | 8/2008 | Chen et al. |
| 2009/0266892 | A1 | 10/2009 | Windauer et al. |
| 2010/0024276 | A1 | 2/2010 | Kellis |
| 2010/0301116 | A1 | 12/2010 | Bennetts et al. |
| 2011/0061286 | A1 | 3/2011 | Wang |
| 2011/0075125 | A1 | 3/2011 | Kanayama |
| 2011/0099881 | A1 | 5/2011 | Jung et al. |
| 2011/0247255 | A1 | 10/2011 | Ding et al. |
| 2012/0000979 | A1 | 1/2012 | Horvath |
| 2012/0044475 | A1 | 2/2012 | Yang et al. |
| 2012/0048931 | A1 | 3/2012 | Arbouw |
| 2012/0097741 | A1 | 4/2012 | Karcher |
| 2012/0182417 | A1 | 7/2012 | Everett |
| 2012/0186130 | A1 | 7/2012 | Tubb |
| 2012/0298750 | A1 | 11/2012 | McCarty et al. |
| 2013/0033746 | A1 | 2/2013 | Brumfield |
| 2013/0040268 | A1 | 2/2013 | Van Der Walt et al. |
| 2013/0047485 | A1 | 2/2013 | Tubb |
| 2013/0170027 | A1 | 7/2013 | Peters et al. |
| 2013/0188180 | A1 | 7/2013 | Jakob |
| 2013/0199074 | A1 | 8/2013 | Paterson |
| 2013/0228616 | A1 | 9/2013 | Millett |
| 2013/0228618 | A1 | 9/2013 | Millett |

(56) References Cited

U.S. PATENT DOCUMENTS

| | | | | |
|---|---|---|---|---|
| 2013/0276345 | A1 | 10/2013 | Hamilton | |
| 2013/0312310 | A1 | 11/2013 | Geller | |
| 2014/0002815 | A1 | 1/2014 | Jaeschke et al. | |
| 2014/0059915 | A1* | 3/2014 | Sammut | F41G 1/38 42/122 |
| 2014/0319215 | A1 | 10/2014 | Farca et al. | |
| 2015/0002856 | A1 | 1/2015 | McCarthy et al. | |
| 2015/0241193 | A1 | 8/2015 | Berthiaume | |
| 2015/0316350 | A1 | 11/2015 | Hamilton | |
| 2016/0084616 | A1 | 3/2016 | Jahromi | |
| 2016/0097628 | A1 | 4/2016 | Wu | |
| 2016/0146576 | A1 | 5/2016 | White et al. | |
| 2016/0252330 | A1 | 9/2016 | Babbitt et al. | |
| 2017/0010068 | A1 | 1/2017 | White et al. | |
| 2017/0241742 | A1 | 8/2017 | Davidson et al. | |
| 2018/0010887 | A1 | 1/2018 | VanBecelaere | |
| 2018/0024376 | A1 | 1/2018 | Dohr et al. | |

FOREIGN PATENT DOCUMENTS

| | | | |
|---|---|---|---|
| CN | 101706232 | A | 5/2010 |
| CN | 201740465 | U | 2/2011 |
| CN | 201844750 | U | 5/2011 |
| DE | 20 2005 015445 | | 1/2006 |
| DE | 102011018947 | | 10/2012 |
| DE | 10 2012 000525 | | 7/2013 |
| EP | 2339290 | | 6/2011 |
| WO | WO 00/50836 | | 8/2000 |
| WO | WO 03/096216 | | 11/2003 |
| WO | 2007/108896 | | 9/2007 |
| WO | 2010/134738 | | 11/2010 |

* cited by examiner

OPTICAL DEVICE HAVING PROJECTED AIMING POINT

CROSS-REFERENCE TO RELATED APPLICATIONS

This application is a continuation of U.S. patent application Ser. No. 13/758,129, filed Feb. 4, 2013, now U.S. Pat. No. 9,091,507, which claims priority to and the benefit of U.S. Provisional Patent Application Ser. No. 61/595,039, filed Feb. 4, 2012, entitled "Optical Device Having Projected Aiming Point," the disclosures of which are hereby incorporated by reference herein in their entireties.

INTRODUCTION

Various scope sighting systems (also referred to as optical devices or sights), for rifles, pistols, or other firearms are known in the art. In general, these include a reticle located in a focal plane between an objective lens and an ocular lens. Additionally, an erector lens assembly is located between the objective and ocular lenses. The erector lens assembly may be movable to allow adjustable sighting of targets at various magnifications. The erector lens assembly allows targets a considerable distance from the rifleman to be viewed more easily through the scope, resulting in more accurate shots. Although the technology of riflescopes has improved over the years, a number of shortcomings are still present with even the most advanced riflescopes.

Aiming at a target requires a number of manual steps by a rifleman. Some of those steps may be forgotten by an inexperienced or rushed rifleman, leading to inaccurate shots. For example, a typical targeting scenario utilizing an optical sight may require first scanning a field of view at a low magnification setting in order to locate and identify a potential target. Once a potential target is identified, the rifleman must determine the range to the target. Certain optical devices allow this distance to be calculated with the press of a button on the optical device. Once the range is determined, the optical device illuminates or otherwise displays an aiming element located on a vertical element of an aiming component (e.g., the reticle), based on the distance to target and ballistic information programmed into the optical device. Thereafter, a rifleman may adjust the magnification setting up or to a maximum setting allowed on the optical device.

Further targeting steps are still required. One of the most common corrections that must be made to properly target is to compensate for crosswind along the flight path of the bullet. Failure to do so, especially at long distances, may cause a bullet to miss its intended target. An electronic scope 100 that may be used to compensate for crosswind is depicted in FIG. 1. The scope 100 includes a housing 102 that has a reticle 104 viewed therethrough. The reticle 104 includes a sighting element 106 having a number of ranged aiming points (represented by horizontal dashes 108 along the sighting element 106). Windage correction marks (represented by dots 110) are also included. In this example, the innermost dots 110 depict compensation required to sight at a 10 mph crosswind. The outermost dots 110 depict compensation required to sight at 20 mph. Any number of dots may be present on either side of a central reticle line to provide aiming points at certain wind speeds. In the case of the illuminated optical device depicted in FIG. 1, once a range is determined, and ballistic information (preprogrammed into a controller) is considered, a base range aiming point 114 is illuminated on the vertical bar of the sighting element 106. If the crosswind W is, for example, 20 mph to the left, the rifleman must then locate the aiming point represented by dot 116 on the target prior to firing. Novice or hurried riflemen however, may miscount windage aiming points or forget this step entirely, and miss their target.

Additionally, this type of riflescope has further limitations in that the rifleman must guess the aiming point for windages different than the indicated dots 110 (e.g., 15 mph, 7 mph, etc.). This problem may not be simply solved by including a large number of windage aiming points, as inclusion of too many windage aiming points would block the view through the reticle 104, making aiming difficult. Additionally, addressable windage aiming points are impractical, since each must be powered by some type of conductor (too many of which would again crowd the field of view).

SUMMARY

In one aspect, the technology relates to an aiming device including: a set of lenses disposed along a linear optical path, the set of lenses including an objective lens and an ocular lens; a reflective element disposed on the linear optical path between the objective lens and the ocular lens; an addressable display located off the linear optical path, the display projecting an image to the reflective element, such that the image is viewable through the ocular lens, wherein the image is an aiming element superimposed on a field of view.

In another aspect, the technology relates to a sighting system including: a set of lenses disposed along a linear optical path, the set of lenses including an objective lens and an ocular lens; a wind sensor for sensing at least one of a wind speed and a wind direction; a processor for calculating a wind uncertainty based at least in part on a signal sent from the wind sensor; a display element for displaying an image viewable through the ocular lens, wherein the image is based at least in part on the wind uncertainty.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
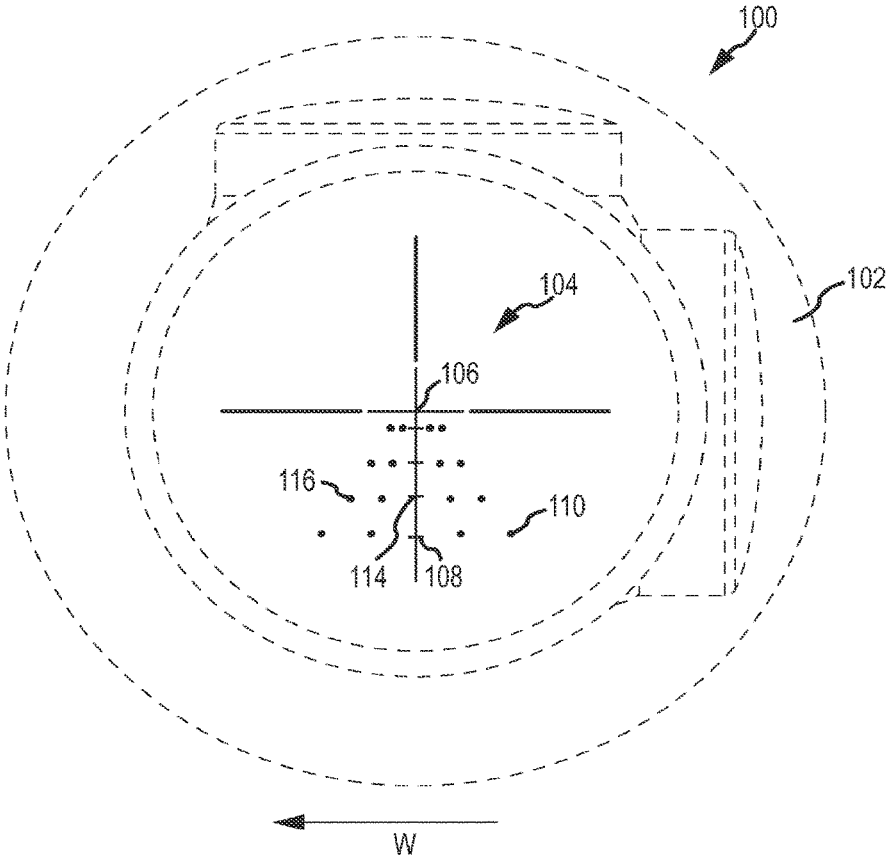
FIG.1 PRIOR ART
FIG. 1 is an end view of a prior art optical device.

The present technology relates to new and improved embodiments of known sighting systems and methods (such as those described in U.S. Pat. No. 7,703,679, the disclosure of which is hereby incorporated by reference herein in its entirety), for correctly aiming a firearm or other implement. In embodiments, the present sighting system includes a lens position sensor, which may also sense the position of a cam tube or power ring, a processor (CPU), and an aiming point that can be manipulated by the CPU either mechanically or electrically. Other embodiments may include an optic device, a range input, a controller/processor, an input system, a ballistics program, and an aiming element display device. The optic device is any device that can visually acquire a target, such as an optical scope (e.g., for a rifle, handgun, etc.), or a camera with a viewfinder. The range input may be input from a range finder that may be any device that can determine the distance between the sighting system and an intended target, such as a laser range finder, sometimes integrated with the optic device. Exemplary integrated optical devices and laser range finders include the 4×-12×-42 mm, LaserScope riflescope, as well as the Eliminator® riflescope, both available from Burris Corporation of Greeley, Colo. In other embodiments, the user may enter the range through the input system 306, described below.

The controller/processor accepts, from the input system, information, for example, information regarding the bullet and/or cartridge characteristics, rifle characteristics, any environmental considerations, and/or the magnification setting. After receiving the input from the input system, the controller/processor requires the range to determine the correct hold over adjustment. The range input provides the range to the target before the rifle is fired. In exemplary embodiments, a range finder, either integral to the optical device or separate from the optical device, or another input system, such as a handheld device, provides the range. Additionally, the controller/processor determines a present magnification setting of the optical device. The controller/processor determines the hold over adjustment and other corrections and automatically addresses or energizes the aiming element display device, as described below. The aiming point is projected onto a beamsplitter located along a linear optical path and appears superimposed on the image of the target. The aiming point represents the point in the field of view of the optical device that should be positioned on the visually acquired target to correctly aim the rifle for the intended shot (expected point of impact). By aiming the rifle with the aiming point, the rifleman can correctly aim the rifle for the target range, wind, magnification setting, other environmental conditions, cartridge characteristics, or other considerations, without needing to manually calculate corrections using graduated markings on the reticle crosshairs or making manual adjustments. In exemplary embodiments, the aiming point is a crosshair on a vertical cross bar, a dot, a circle, a donut, a box, a triangle, or other possible visual representation of the aiming point.

Figure 2:
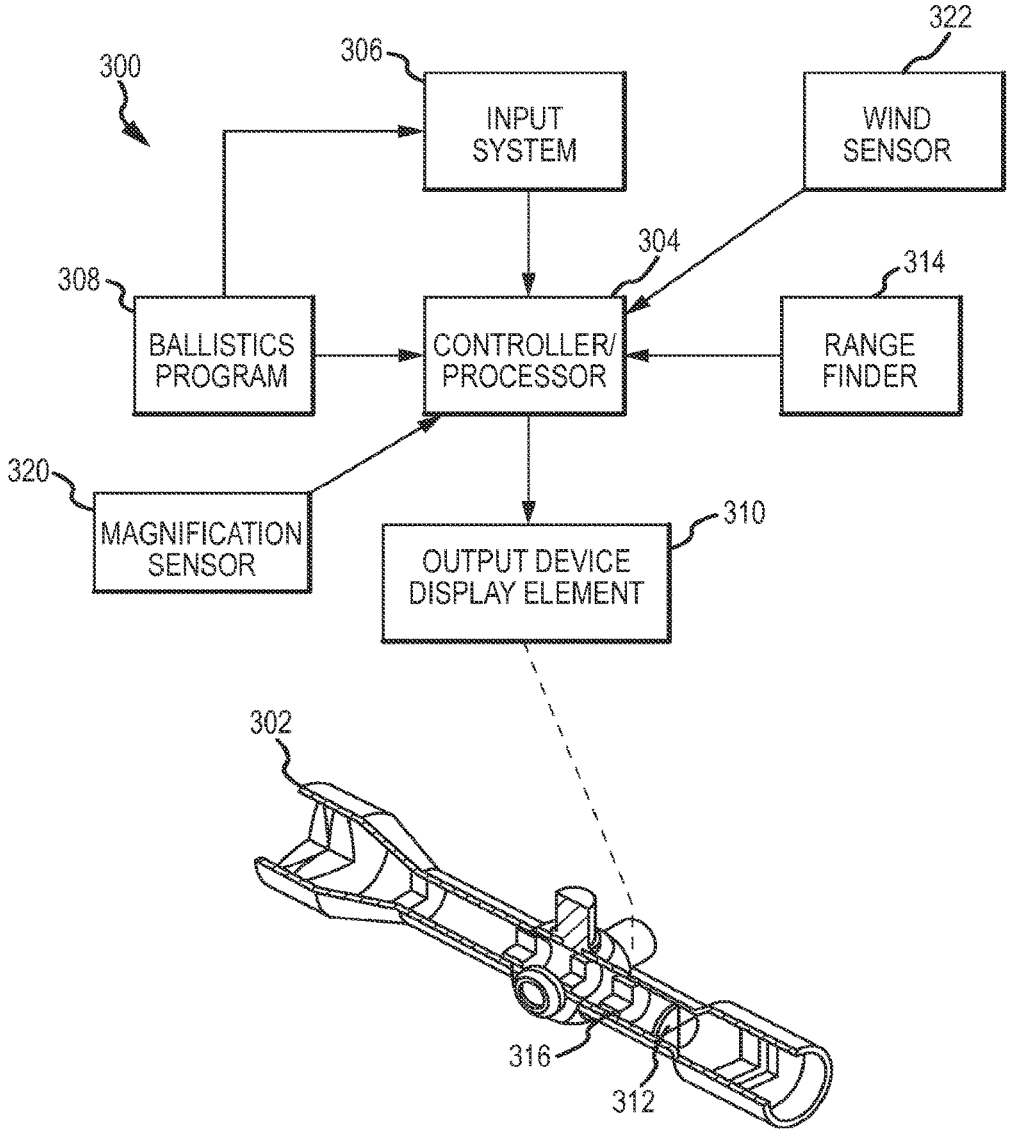
FIG. 2 is a schematic diagram of an optical device.

An exemplary sighting system 300 for visually acquiring a target and automatically providing a corrected aiming point in accordance with the present invention is shown in FIG. 2. As used herein, a "sighting system" shall be construed broadly and is defined as one or more optical devices and other systems that assist a person in aiming a firearm, a rifle or other implement. The sighting system 300 comprises an optic device 302, such as a rifle scope or optical system attached to a firearm or other implement, an input system 306, a ballistics program 308, a controller/processor 304, and one or more output devices 310, such as an addressable display element that projects an aiming point onto an element 316 located within a linear optical path of the sighting system. In further embodiments, the sighting system also comprises a range input, such as from a range finder 314. Herein, the optic device 302 will often be referred to as the rifle scope or scope, although the present technology is not limited to the use of a riflescope. Additionally, the implement or firearm will hereinafter be referred to as the rifle, although the present technology is not limited to use with rifles or other firearm, or any implements that launch a projectiles. In embodiments, the riflescope 302 provides an etched reticle on a lens 312 surface, or vertical and horizontal crosshairs to aim the rifle. The reticle may be located at the front or rear focal plane.

The controller/processor 304 of the exemplary system 300 receives inputs or data from an input system 306 and a range input, such as a range finder 314 and is operable to execute a ballistics program 308 or receive information from the input system 306 pertaining to the ballistics program 308. The controller/processor 304 uses the input information to determine a correct aiming point for the scope 302. In embodiments, the controller/processor addresses or powers one or more pixels located on the display 310 that correspond to the desired aiming point. In certain embodiments, the display 310 may be a high resolution microdisplay manufactured by MicroOLED of Grenoble, France. All required drivers are also incorporated into the system 300.

OLED microdisplays may also be obtained from eMagin Corporation, of Bellevue, Wash. Acceptable units and sizes include WUXGA, having a display of 1920 pixels×1200 pixels at 18.7×11.75 mm; SXGA (1280×1024 at 15.36×12.29 mm); SVGA (852×600 at 12.78×9.00 mm); and VGA (640×480 at 9.6×7.2 mm). Other OLED microdisplays are available from Yunnan North OLiGHTEK Opto-Electronic Technology Co., Ltd., of Kunming, China, model numbers SVGA050 and SVGA060. In addition, reflective LCD, transmissive LCD, and MEMS systems may be utilized for the microdisplay. The microdisplay may be color or monochrome. Although color microdisplay may provide for a more satisfying user experience (e.g., using various or changing colors to highlight particular images in a field of view, wind intensity levels, etc.), monochrome microdisplays require less power to produce a comparable amount of emitted light. In that case, monochrome microdisplays may be advantageous in that they have less impact on battery drain, which may be important in certain embodiments (e.g., military or other scope applications where access to power sources is limited during extended deployments in the field).

Additionally, a magnification sensor 320 may be included that determines erector lens positions. Additionally, the display element 310 may be used in conjunction with fixed power sights. A variety of sensors may be used, including those that sense and output the positions of the erecting lens, that sense and output the angular position of the cam tube, or that sense and output the angular position of the power (magnification) ring. For sensors 320 that provide position output, the output may be used to determine the change in erecting lens positions relative to one another, from any magnification setting in relation to the predefined magnification setting or original erecting lens positions at that predefined magnification set point. In certain embodiments, this can be mechanically done or electrically via the CPU. The CPU calculates to where in the current field of view the aiming point needs to be relocated, based on the actual magnification setting in relation to the predefined magnification setting, and on the sensor output and the original location of the erecting lens.

A wind sensor 322 may also be integrated with the scope or located remote therefrom. Remote wind sensors may be connected to the scope 302 for delivery of wind information with a wired or wireless connection. Alternatively, a rifleman may directly enter information obtained from a remote wind sensor via the input system 306. Other sensors may also be included in the scope 302. These may include sensors that monitor barometric pressure, wind direction, temperature, humidity, or other environmental elements. Information derived from these sensors may be used by the processor 304 in the various calculations described below.

The controller/processor 304 is a hardware or combination hardware/software device for processing the input information, for determining a correct aiming element to address or energize on the display 310, and for controlling the display 310. In exemplary embodiments, the controller/processor 304 is a microcontroller or microprocessor, for example the 8-bit MCS 251 CHMOS microcontroller available from Intel® Corporation. In other embodiments, the controller/processor 304 is a custom-made; application specific integrated circuit or field programmable gate array that is operable to perform the functions described herein.

Figure 3:
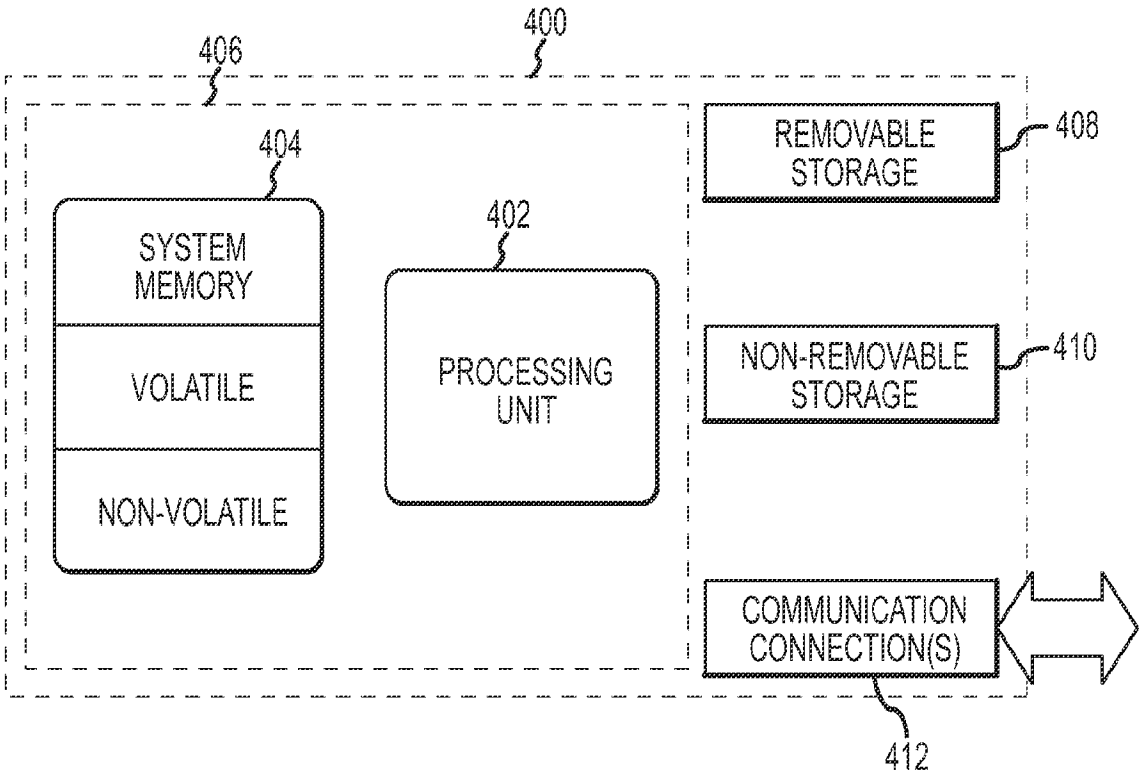
FIG. 3 is a schematic diagram of a controller processor for operating an optical device.

In embodiments, the controller/processor 304 includes any electronics or electrical devices required to perform the functions described herein. For example, an embodiment of a suitable operating environment in which the present invention may be implemented is shown in FIG. 3. The operating environment is only one example of a suitable operating environment and is not intended to suggest any limitation as to the scope of use or functionality of the invention. Other well-known controller/processor systems, environments, and/or configurations that may be suitable for use with the invention include, but are not limited to, hand-held devices, multiprocessor systems, microprocessor-based systems, programmable consumer electronics, or other computing environments that include any of the above systems or devices, and the like.

With reference to FIG. 3, an exemplary computing environment for implementing the embodiments of the controller/processor 302 (FIG. 2) includes a computing device, such as computing device 400. In its most basic configuration, computing device 400 typically includes at least one processing unit 402 and memory 404. Depending on the exact configuration and type of computing device 400, memory 404 may be volatile (such as RAM), non-volatile (such as ROM, flash memory, etc.), or some combination of the two. The most basic configuration of the controller/processor is illustrated in FIG. 3 by dashed line 406.

Additionally, device 400 may also have additional features/functionality. For example, device 400 may also include additional storage. Such additional storage is illustrated in FIG. 3 by removable storage 408 and non-removable storage 410. Such computer storage media includes volatile and nonvolatile, removable and non-removable media implemented in any method or technology for storage of information such as computer readable instructions, data structures, program modules, or other data. Memory 404, removable storage 408, and non-removable storage 410 are all examples of computer storage media. Computer storage media includes, but is not limited to, RAM, ROM, EEPROM, flash memory, or other memory technology. Any such computer storage media may be part of device 400.

Device 400 may also contain communications connection(s) 412 that allow the device to communicate with other devices. Communications connection(s) 412 is an example of communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media.

Computing device 400 typically includes at least some form of computer readable media, which can be some form of computer program product. Computer readable media can be any available media that can be accessed by processing unit 402. By way of example, and not limitation, computer readable media may comprise computer storage media and communication media. Computer storage media includes volatile and nonvolatile, removable and nonremovable media implemented in any method or technology for storage of information such as computer readable instructions, data structures, program modules, or other data. Combinations of any of the above should also be included within the scope of computer readable media.

In embodiments, one form of computer readable media that may be executed by the controller/processor 304 is the ballistics program 308, as shown in FIG. 2. The ballistics program 308 is any data and/or executable software instructions that provide ballistics information. For example, the ballistics program is the Infinity Suite of exterior ballistics software offered by Sierra Bullets of Sedalia, Mo. Ballistics information is generally defined as any data or information that describes the flight of a projectile, such as a bullet under the influence of environmental, gravitational, or other effects. The ballistics information may be based on information received about the mass of the bullet, the bullet's coefficient of drag or other ballistic coefficients, the muzzle velocity, humidity, barometric pressure, wind velocity, wind direction, altitude, angle of the shot, range, diameter of the bullet, twist angle of the rifle relative to vertical (cant), cartridge designation, and other considerations. As one skilled in the art will recognize, some or all of this input information can be used to determine characteristics of a bullet's flight. In other embodiments, a ballistics program calculates ballistics information, which is provided in a look-up table. Thus, rather than calculate the ballistics information, a set of ballistics information is pre-calculated and used by the processor/controller 304.

Figure 4:
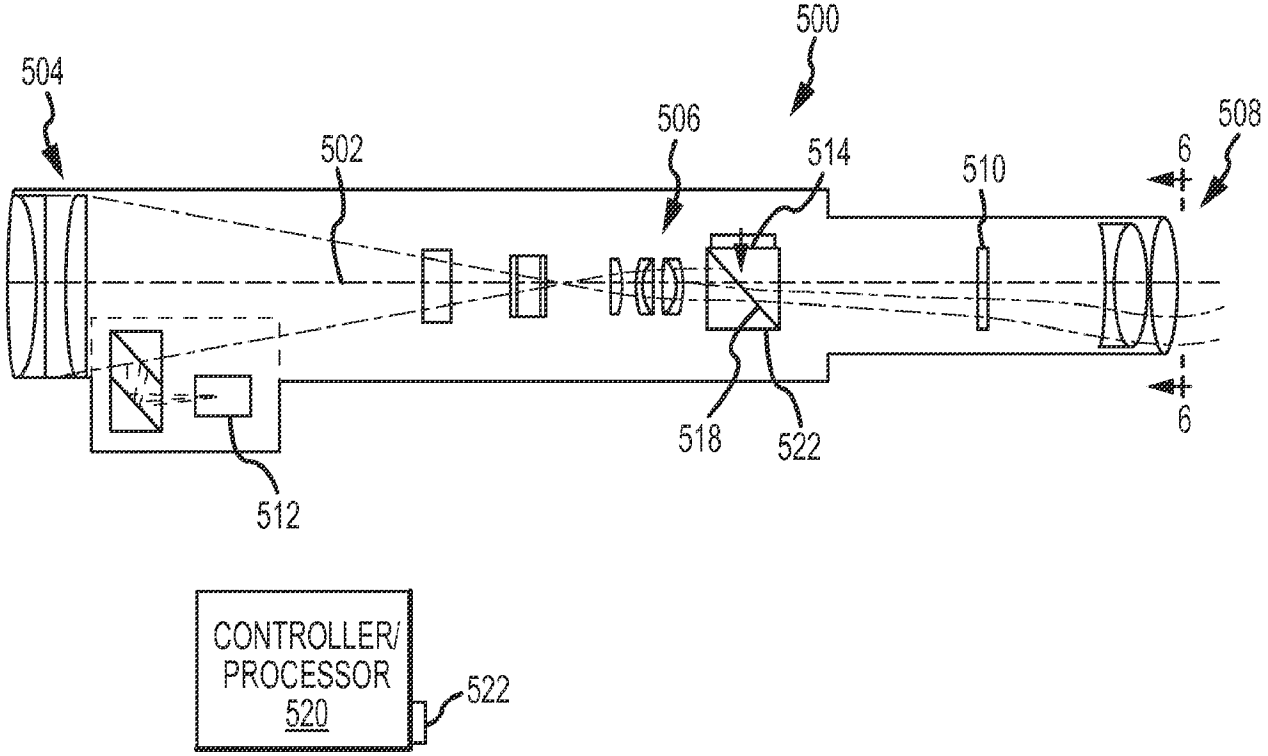
FIG. 4 is a schematic side sectional view of an optical device.

FIG. 4 is a schematic side sectional view of an optical device 500. The optical device 500 includes a set of lenses disposed along a linear optical path 502 including an objective lens 504 or lens assembly, an erector lens assembly 506 and ocular lens 508 or lens assembly. A conventional reticle 510 may or may not be included. If included, it may be a plano with reticle etched thereon or other type.

In the scope embodiment shown, the laser rangefinder assembly 512 is also illustrated. The rangefinder is disposed between the objective lens 504 and the erector lens assembly 506. The rangefinder 512 includes a rangefinding light transmitter that transmits a beam through the objective along the linear optical path and a rangefinding light receiver that receives the rangefinding light reflected back to the telescopic sight along the linear optical path through the objective lens. The rangefinder generates a range signal indicative of a range of the target object reflecting the rangefinding light.

The rangefinder signal is then provided to the controller 520. The controller 520 includes a memory for storing ballistics information, such as in the form of a lookup table as described above. In alternative embodiments, a ballistic calculator and stored data required to calculate point of impact ballistics information may be included. Based on the ballistics information, environmental parameters, orientation information, and the rangefinder signal, the controller 520 determines which pixels on the display 514 to illuminate in order to present an aiming point that compensates for the range of the target, windage, etc. The controller 520 is provided with a communication port 522 through which ballistics information, aiming point shapes and user selections (e.g., of color, ammunition type, reticle shape) may be uploaded in the sight's memory. In the embodiment shown, the display 514 projects an image perpendicular to the linear optical path 502. The image intersects a beamsplitter 518 located within an optical element 522 and is then visible in addition to the normal target image, along the optical linear path 502, through the plano 510 and the ocular lens 508.

Published data for Ballistic Coefficient (BC) and Muzzle Velocity (MV) specific bullets and loaded ammunition is often not accurate. Manufactures often use techniques that optimize performance values to levels higher than can be expected in normal field conditions. Additionally, variations in individual firearms also have very significant influence on MV particularly barrel length, bore diameter variations, rifling, chamber and throat particulars, gas ports, and other specifics affect MV from a given load. Although a bullet's BC is affected very little by specifics of a particular firearm, significant errors in ballistic characteristics arise from different ways to determine it being used by different manufactures.

Significant improvement in the accuracy of BC and MV can be determined by a scope system by utilizing atmospheric condition sensing along with inclination and/or orientation sensing, scope mounting height input, and actual measured bullet drop at known range values. The system can mathematically determine to a degree inherently accurate to the firearm and scope combination, as assembled, with careful zeroing of the scope, and subsequent input of actual drop at additional ranges, under known atmospheric, inclination, and distance information. In certain embodiments, drops at at least two other ranges, in addition to the zero distance, may be utilized. This same process inherently corrects for variations in the scope itself. The input and/or communication systems mentioned above, along with the atmospheric and physical conditions sensing components, can be used to gather and store the appropriate information.

Additionally, accurate ballistic information can be gathered and stored on additional cartridges that can then be used in the firearm and scope combination as assembled. This information may include information on the zero distance point of impact. The input system can then be used to input the type of ammunition being used. The processor can then display accurate point of aim indication as needed for the calculated expected point of impact for the loading in use.

Figure 5:
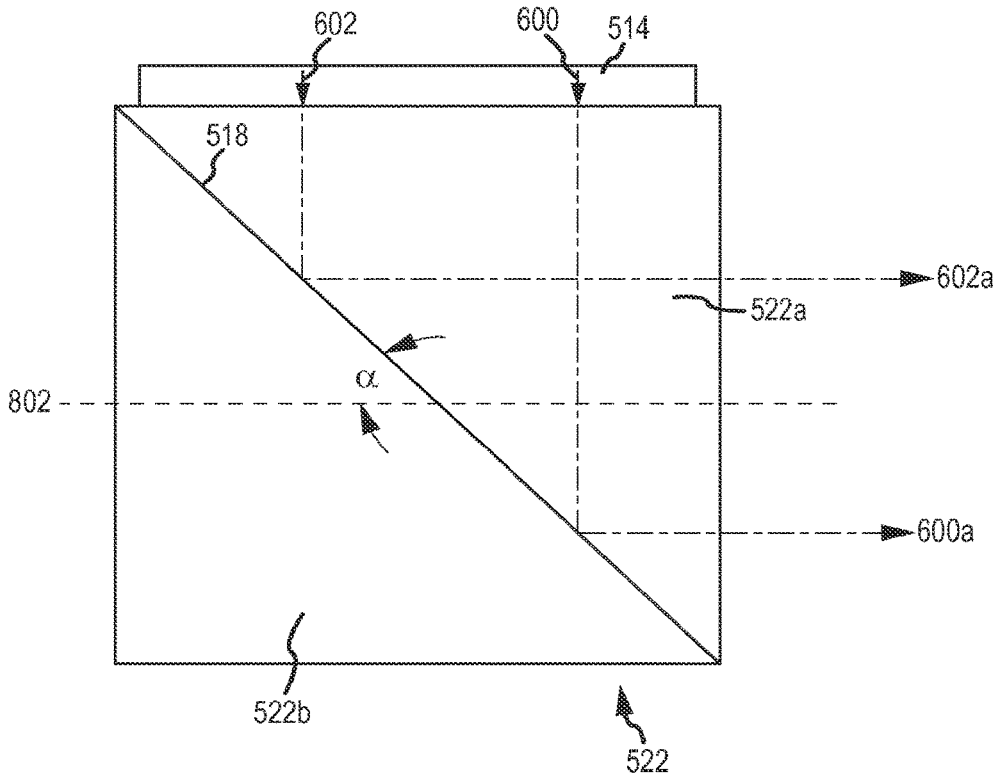
FIG. 5 is a partial enlarged side sectional view of the optical device of FIG. 4.
Figure 6:
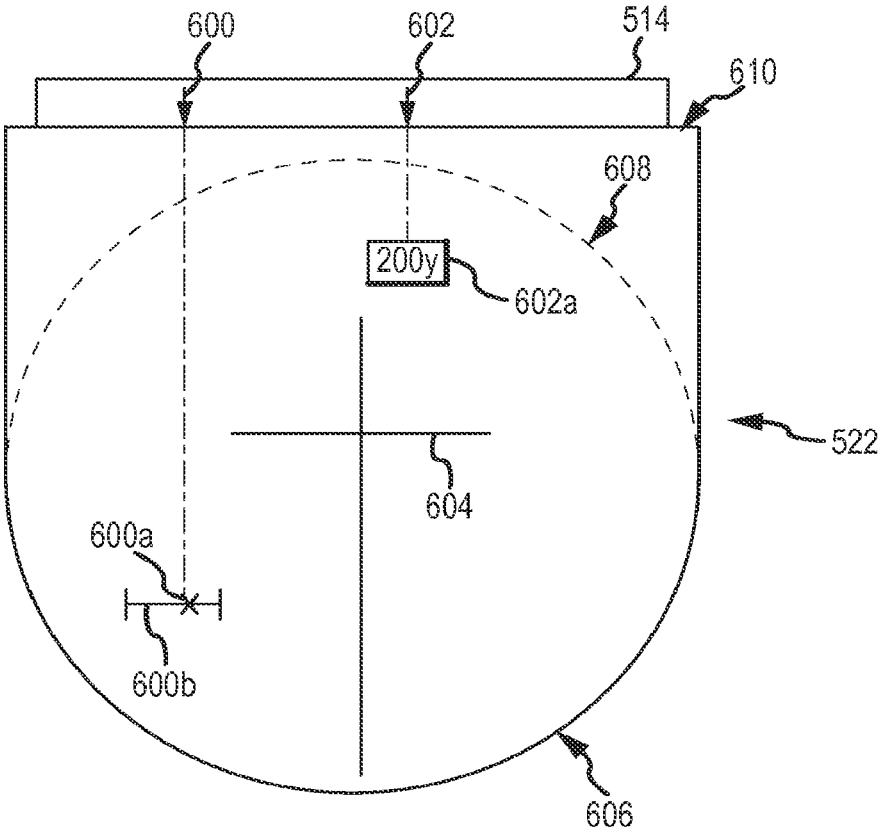
FIG. 6 is an end view of an optical display system.

FIG. 5 depicts an enlarged side view of the display 514 and optical element 522. FIG. 6 depicts an enlarged end view of the optical element, through the ocular lens 508. The optical element 522 may include two triangular glass prisms 522*a*, 522*b* joined at a reflecting surface 518. The prisms 522*a*, 522*b* are joined using Canada balsam or other adhesive materials. Additionally, half-silvered mirror beamsplitters, dichroic mirrored prisms, or other types of beamsplitters may be utilized. In the depicted embodiment, the reflective surface is at an angle $\alpha$ of about 45 degrees to the optical linear path 502. This angle is desirable in embodiments where the display 514 is mounted perpendicular to the optical linear path 502. Alternate angles may be utilized, based on the angle of the display 514 relative to the linear optical path 502.

In the depicted embodiment, the display 514 may illuminate any number of pixels located thereon, thereby projecting an aiming point to virtually any location of the beamsplitter 522. In some applications, however, the display need only illuminate pixels that display aiming points below the main horizontal cross of the reticle. In that regard, the lower half of the beamsplitter may include a reflective surface, while the upper half may be completely transmissive. In other embodiments, the reflective coating is optimized to reflect the specific color or colors emitted by the display. FIG. 6 depicts an embodiment, as viewed through the plano 510 that includes the crosshairs 604. In other embodiments, the crosshairs may be projected by the display 514. The upper dotted line 608 depicts the upper limit of the viewfinder. The beamsplitter 522 may include a curved lower surface 606 to fit within the optical device. In alternative embodiments, the display 514 and the beam splitter are rotated about the primary optical axis such that the display may be located below or on a side of the beamsplitter 522. Additionally, multiple displays may be located on the beam splitter. In such an embodiment, one display may project aiming elements, another, a crosshair, and still another may project additional information (e.g., range to target or other information).

Two images 600, 602 are depicted, though during most targeting operations, only a single aiming point will be projected. In the depicted application the aiming point 600 is projected to appear below the horizontal line of the crosshair 604, as a point, dot, circle, cross, "x", donut, triangle, classic reticle, or other element 600*a*. In certain embodiments different aiming elements may be utilized at different magnification settings (e.g., a cross at 4× magnification, a circle at 8× magnification). Additionally, one or more preferred aiming elements may be selected by the user based on personal or other preferences or settings. Any number and type of aiming element may be included with the sighting system or may be added via a communication port.

Additionally, the element 600*a* may be any combination thereof and may include various colors or combinations of colors. With a wind sensor in communication with the processor, a line, or other horizontal pattern 600*b*, may be displayed in conjunction with the element 600*a* to depict wind uncertainty due to wind gusts or variations. The processor may determine the extent of the uncertainty and determine where on the line 600*b* the aiming element 600*a* should be located.

The display 514 may also project images (such as aiming points, windage measurement data, range data, etc.) in the upper or other areas of the viewfinder to provide the rifleman with additional information. In the depicted embodiments projected image 602 appears in the viewfinder as yardage measurement 602*a*. This projected image 602 may include other data elements, as required or desired for a particular application, such as range, wind speed, wind direction, barometric pressure, etc. Changes in magnification settings may also result in a change in size and/or location of the projected image 602*a*. The display 514 may also project an image of a crosshair or other basic sighting elements. Additionally, the data elements may be displayed by a supplemental display device (such as an OLED) located proximate the rear focal plane.

The display 514 may be secured to the upper surface 610 of the beamsplitter 522 with optical cement to ensure adequate transmission of the images to the beamsplitter 522. The optical cement also secures the display against lateral or rotational movement, which may occur as the firearm is used in the field. The display may be mounted and aligned using physical alignments means and/or electronic calibration procedures. With regard to physical alignment means, the display 514 may be inserted into a recess within the beamsplitter 522 sized to fit the display 514. The boundaries of the recess may be aligned such that the display 514 will project images to the proper location on the beamsplitter 522 upon activation, with no need for further calibration. Additionally, the display 514 may be mounted to an intervening lens located between the beamsplitter 522 and the display 514. The display 514 also need not be mounted such that it projects perpendicular to the linear optical path 502. For example, the display may be mounted such that it projects parallel to the linear optical path 502. An intervening mirror may be used to direct the displayed images to the beamsplitter. A display located such as depicted in FIG. 5, however, is desirable, as it reduced the overall height of the scope 500.

Figure 7A:
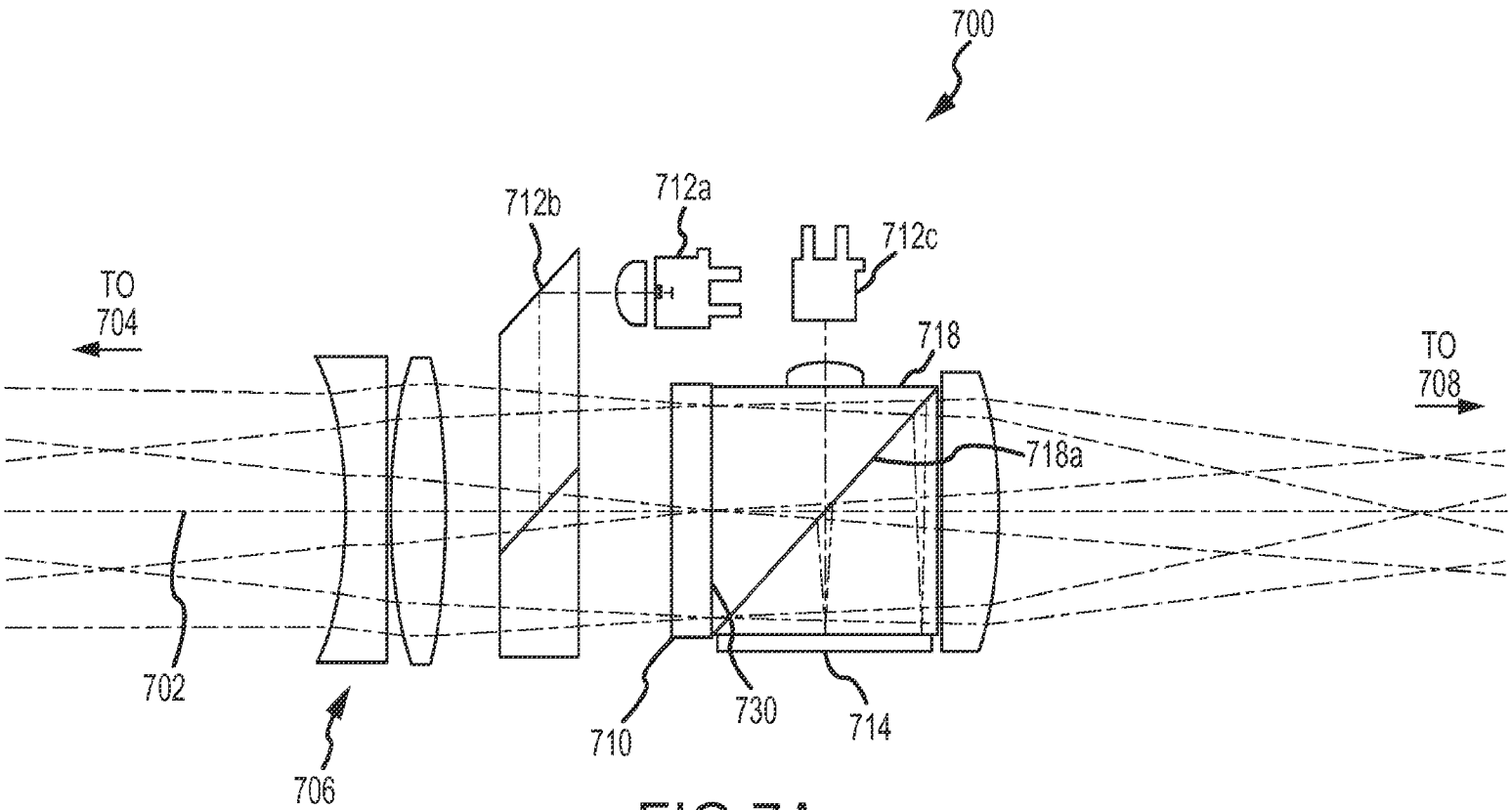
FIG. 7A is a partial schematic side sectional view of an optical device having a microdisplay located at a front focal plane.

FIG. 7A is a partial schematic side sectional view of an optical device 700 having a microdisplay 714 located at a front focal plane 730. In FIG. 7A, other lenses, such as an objective lens set 704, and ocular lens set 708 are not depicted, but would be apparent to a person of skill in the art. In the depicted embodiment, an erector lens assembly 706 and a plano with a fixed reticle are located between a beam splitter 518 and the objective lens set 704. Additionally, elements in this embodiment include a range finder system that includes a laser beam sender 512*a* disposed outside the linear optical path 702. A range finder beam splitter 712*b* directs laser beam into the optical path 702, while a range sensor 712*c* receives the reflected laser signal.

When utilizing a microdisplay 714 at the front focal plane 730, as depicted in FIG. 7A, it may be desirable to compensate for magnification changes to create a more desirable viewing experience. For example, the microdisplay 714 may change textural display size and location to compensate for changes in magnification and the field of view affects in the front focal plane. Limitations regarding the actual pixel size of the display may limit the ultimate image displayed in the viewfinder. For a given display size, pixel size is a direct function of display resolution. For example, scopes capable of higher magnification represent more of a technological challenge, as a fewer number of pixels on an aiming point are lit as the magnification setting is increased. Similarly, text used to display range, wind speed, etc., also scale as magnification is increased. Accordingly, microdisplays having a high number of pixels may be particularly desirable to allow full functionality of scopes such as those described herein. It has been determined that for a front focal plane system microdisplays having a pixel size of about 17 microns or less at 20× magnification are desirable to maintain accuracy and visibility. This is dependent on magnification change range, and actual viewable field at maximum magnification. It may be desirable to utilize a default display for situations when a range cannot be found, due to, for example, failure of the laser range finder emitter 712*a* and/or receiver 712*c*, or the computational system that calculates range.

Figure 8C:
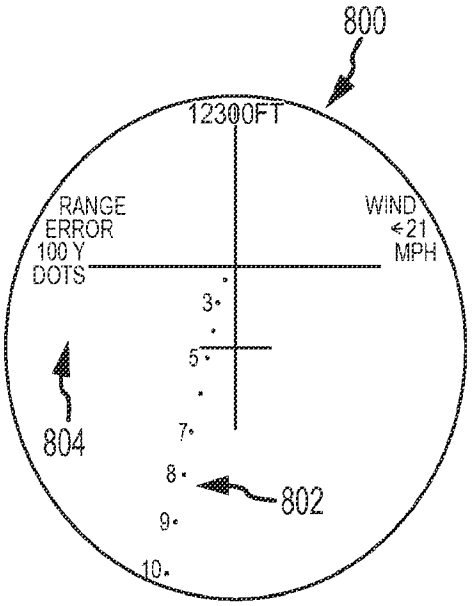
FIGS. 8A-8C depict a range fault display for an optical display system, at 4×, 8×, and 12× magnifications, respectively.
Figure 8B:
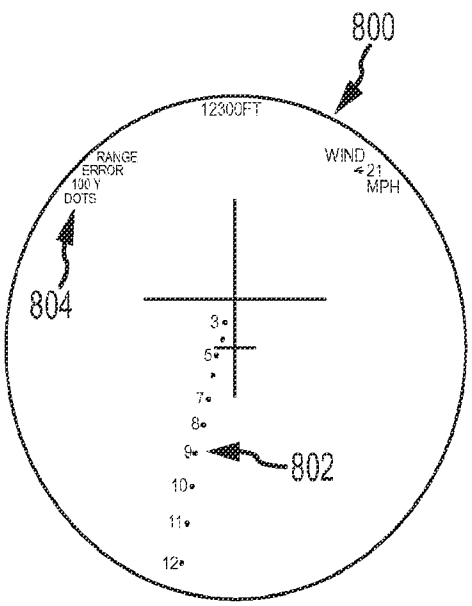
Figure 8A:
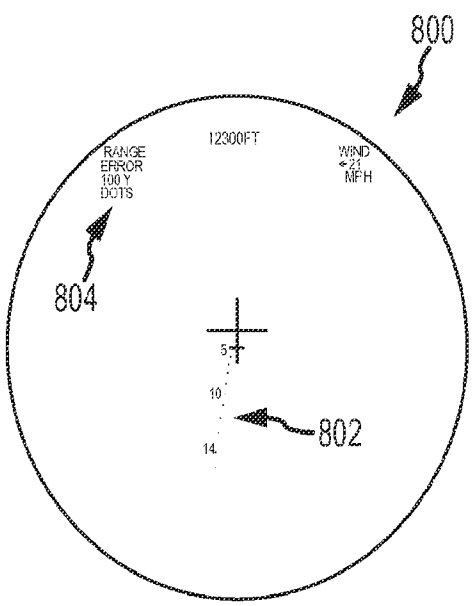

When a range finder error is detected by the processor, the microdisplay may revert to a default projection such as the type depicted in FIGS. 8A-8C, which depicts the display at 4×, 8×, and 12× magnifications, respectively. The display 800 may be of a series of aim marks 802 at various distances, such as 100-yard or meter increments. The aim marks 802 can be appropriately labeled and properly offset for atmospheric conditions including wind, and physical conditions such as firearm inclination angle. In the depicted embodiment an error notice 804 is also displayed on the display 800, so the user may understand the conditions under which the optic device is operating. Other available information, in this case elevation and wind speed and direction may continue to be displayed.

Figure 9B:
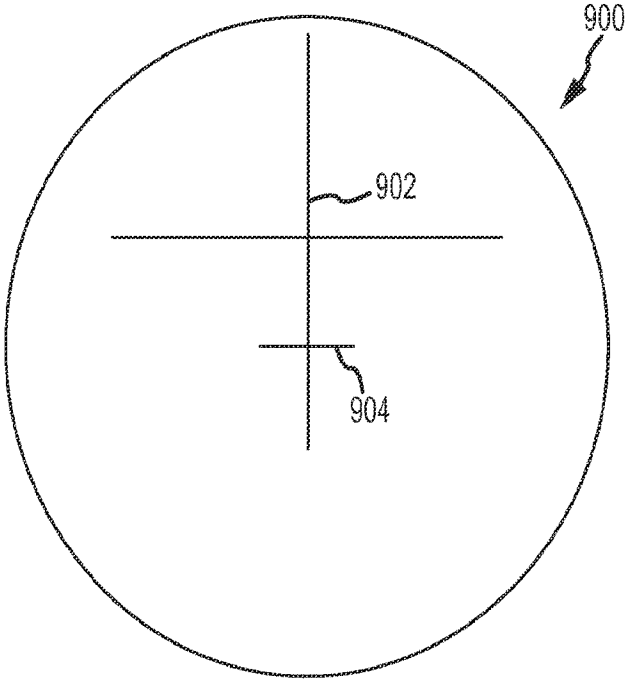
FIGS. 9A-9B depict a display for an optical display system at low and high magnifications, respectively.
Figure 9A:
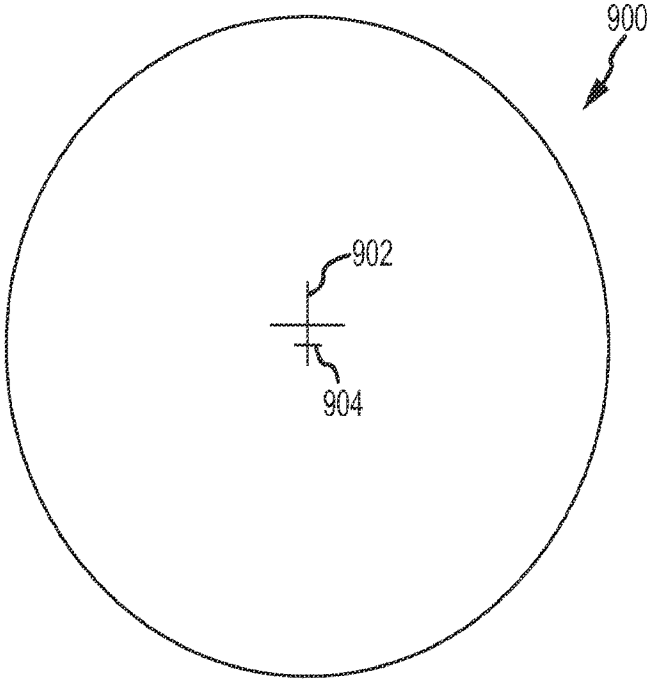

Returning to FIG. 7A, the optical device 700 using a single beam splitter 718 to direct both the display 714 image and the laser beam as it returns to the sensor 712*c*. Here, the beam splitter 718 may be a full ray trace or a near-full ray trace width splitter. The internal diagonal splitter surface 718*a* reflects and overlays the display image towards the ocular lens 708 and eyepiece. In effect, it only uses the rear (ocular) half of the beam splitter 718. The returned laser beam, however, travels along the optical path 702 from the direction of the objective lens 704. The full trace or near-full trace width splitter 718 reflects this returned laser about 90° to the sensor 712*c*. The laser beam may be further refractively or reflectively focused and routed as necessary. The front (objective) half of the beam splitter 718 is used for this task. Reflective coatings on the diagonal splitter surface can be optimized for the specific wavelengths involved. In front focal plane embodiments such as the type depicted in FIG. 7A, the plano 710 includes a fixed reticle that contains a fixed crosshair or other visual indicator to show the weapon zero location. This is depicted in the display 900 of FIGS. 9A and 9B, at low and high magnifications, respectively. Here, the fixed crosshair 902 is formed in the plano 710. The display 900 also includes one or more separate laser ranging aim marks 904, which are displayed by the microdisplay 714 of FIG. 7A. It may be desirable to locate the laser ranging aim mark 904 in the center of the field of view. Alternatively or additionally, the microdisplay can be programmed to illuminate a laser ranging aim mark at a different location from the aiming or zeroing aim mark. Also, the ranging aim mark 904 can be different from the aiming mark or marks to allow the user to differentiate between them.

For most optical layouts, the front focal plane (FFP) image, even at lowest magnification, is smaller than the rear. Accordingly, it does not require as large of a beam splitter or display. A smaller splitter saves weight, expense, and mounting inconvenience. No matter what location in the FFP is chosen for a weapon zero, that location stays constant relative to the target image as magnification changes. That will allow the zero aim indication to be above the center of the field of view. In turn, this allows a greater angle for bullet drop correction. In certain embodiments, 40 moments of arc (MOA) or more of correction at high magnification is highly desirable, where 1 MOA equals one minute of angle, which equals 1/60 of a degree). FFP implementation, then, allows as much as 30 MOA additional drop correction, depending on actual maximum magnification and optical design. A second advantage of FFP is that parallax between the target image and the display image, particularly at the edge of the field of view, needs to be minimal to prevent point of impact errors. Generally, FFP target images are flatter than those in a rear focal plane device. Additionally, in the FFP, when at high magnification only the centermost portion of the image plane is viewed, which minimizes parallax problems. FFP can also allow dual use of a single beam splitter by both the rangefinder and the display, as discussed elsewhere.

FFP devices do have some functional characteristics that should be considered when used in conjunction with the display technology described herein. For example, at high magnification, the field of view comprises a small portion of the target image. A 4× magnification change, for example, will have one quarter the field of view diameter of the lower magnification diameter. Accordingly, if the display fills or significantly fills the low magnification FOV, only a small portion of the display would be visible at high magnification. A single display pixel is the smallest change that can be made to the display for drop, wind, or other corrections. Long range use of an FFP device may necessitate aiming accuracies of 0.5 MOA, or lower. To fill all or most of the field of view at low magnification, the same display may require significantly more pixels.

Figure 7B:
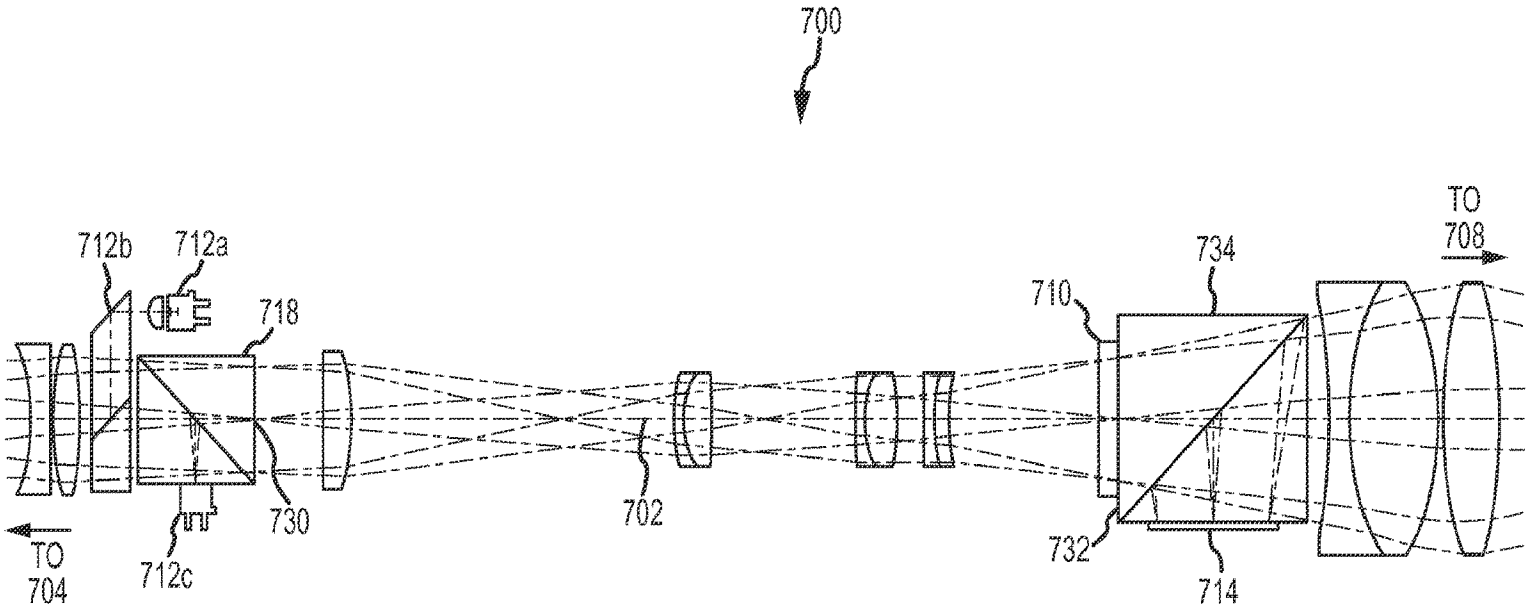
FIG. 7B is a partial schematic side sectional view of an optical device having a microdisplay located at a rear focal plane.

FIG. 7B is a partial schematic side sectional view of an optical device 700 having a microdisplay 714 located at a rear focal plane 732. Elements that share reference numbers with elements introduced in FIG. 7A are typically not described further, as they are substantially similar. In addition to the rear focal plane 732, the optical device 700 includes a number of other elements and components configured as described below. Notably, the range finder system, that is, the beam emitter 712*a*, beam splitter 712*b*, and beam sensor 712*c*, are located proximate the objective lens set 704. Unlike the display of FIG. 7A, here, the objective beam splitter 730 only redirects the beam to the range sensor 712*c*. In FIG. 7B, the microdisplay 714 is located at a rear focal plane 732 and projects an image onto a second beam splitter 734. A plano 710 having a fixed reticle is also located at the second beam splitter 734. Typically, the second beam splitter 734 and microdisplay 714 are larger than those located on the front focal plane.

In rear focal plane (RFP) implementation of the display technology described herein, a larger display and beam splitter may be desirable. However, the field of view on the display is constant regardless of magnification change. As magnification of the target image is changed, the display image is not affected. The only location in the field of view that remains constant relative to the target image, however, is at or very near the center of the field of view. Accordingly, the zero aim mark (particularly the fixed, non-projected, aim mark) should be in the center of the field of view. Therefore, the only aim point offset for bullet drop is from the center of the field of view down, so maximum offset at maximum magnification is more limited. Additionally, a 25 MOA aiming offset at maximum magnification is four times further from the zero aim mark location on the display than at the lowest magnification (in a 4× zoom device). The processor can accommodate this but it a magnification change sensor may be desirable to maintain accuracy.

Parallax due to target image field curvature, particularly at the edge of the field of view, exists in RFP devices. Some advantages to RFP devices are that the pixel size can be much larger than FFP devices, since a larger number of pixels are visible at high magnification as well as at low magnification. Typically, pixels can be 60 microns or more (depending on actual magnification and optics design). The same effect allows resolution of the display to be lower, proportional to magnification change, than in a FFP implementation.

Electronic calibration procedures would include activating a number of reference pixels located on the display, and ensuring that those pixels align with discrete reference points on the reticle, crosshairs, or arbitrary alignment points on the plano 510. For at least this reason, a display that may project an image larger than the viewable area of the viewfinder is particularly advantageous. After the display is mounted and calibrated, any area of the display that would project an image outside of the viewable area may be disabled (or the software may be programmed to not energize the pixels in these areas). A number of pixels may be tested at various magnification settings to ensure calibration at all magnification levels.

The embodiments described above include a reticle etched on the plano 510. In other embodiments, the reticle may form a part of the projected image from the display. Such an embodiment may require fewer or simplified calibration procedures, since the position of the aiming point relative to the reticle would always be known by the processor. However, in the event of a failure of the display, no reticle would be visible through the viewfinder. Therefore, an etched reticle located on the plano may be advantageous, as basic aiming procedures may be made, even in the event of display or other electronic failure.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A sighting system comprising:

a housing;

a set of lenses disposed in the housing and along an optical path, the set of lenses including an objective lens and an ocular lens;

a wind sensor disposed on the housing for sensing at least one of a wind speed and a wind direction;

a processor disposed in the housing for calculating a wind uncertainty based at least in part on a signal sent from the wind sensor; and a display element disposed in the housing for displaying an image viewable through the ocular lens, wherein the image is based at least in part on the wind uncertainty.

2. The sighting system of claim 1, wherein the image comprises a bar.

3. The sighting system of claim 2, wherein the image further comprises an element disposed on the bar.

4. The sighting system of claim 3, wherein displayed bar depicts the wind uncertainty.

5. The sighting system of claim 1, further comprising a reflective element disposed on the optical path between the objective lens and the ocular lens, and wherein the display element is located off the optical path, the display element projecting the image to the reflective element, such that the image is viewable through the ocular lens.

6. The sighting system of claim 1, further comprising an adjustable erector lens assembly disposed on the optical path.

7. The sighting system of claim 6, further comprising a sensor for determining a change in a location of at least one erector lens of the adjustable erector lens assembly.

8. The sighting system of claim 7, wherein the processor is configured to receive a signal from the erector lens sensor, wherein the processor determines a desired aiming point to be displayed by the display element based at least in part on the signal received from the erector lens sensor.

9. The sighting system of claim 7, wherein the processor is configured to receive a signal from the erector lens sensor, wherein the processor determines at least one of a size and a location for the display of at least one of a range, a wind speed, a wind direction, a cartridge designation, and a barometric pressure.

10. The sighting system of claim 1, further comprising a rangefinder.

11. The sighting system of claim 10, wherein the processor determines a desired aiming point based at least in part on a signal received from the rangefinder.

12. The sighting system of claim 11, wherein the processor determines the desired aiming point based at least in part on at least one of an erector lens sensor signal, a ballistic information, a range signal, a wind speed signal, a wind direction signal, a barometric pressure signal, a humidity signal, and a temperature signal.

13. The sighting system of claim 1, wherein the image comprises an aiming element comprising a first aiming element at a first magnification, and a second aiming element at a second magnification.

14. The sighting system of claim 13, wherein the aiming element may be selected based on a user preference.

15. The sighting system of claim 13, wherein the first aiming element and the second aiming element are user selectable.

16. The sighting system of claim 1, wherein the image further comprises data corresponding to at least one of a range, a wind speed, a wind direction, a cartridge designation, and a barometric pressure.

* * * * *